US008333448B2

(12) United States Patent
Yoon et al.

(10) Patent No.: US 8,333,448 B2
(45) Date of Patent: Dec. 18, 2012

(54) REFRIGERATOR WITH RISE INDUCTION MEMBER

(75) Inventors: Jong-Seok Yoon, Gyeongsangnam-Do (KR); Anthony Ogg, Fort Lee, NJ (US)

(73) Assignee: LG Electronics, Inc., Seoul (KR)

( * ) Notice: Subject to any disclaimer, the term of this patent is extended or adjusted under 35 U.S.C. 154(b) by 508 days.

(21) Appl. No.: 12/518,784

(22) PCT Filed: Aug. 20, 2007

(86) PCT No.: PCT/KR2007/003975

§ 371 (c)(1),
(2), (4) Date: Mar. 1, 2010

(87) PCT Pub. No.: WO2008/078870

PCT Pub. Date: Jul. 3, 2008

(65) Prior Publication Data

US 2010/0171402 A1 Jul. 8, 2010

(30) Foreign Application Priority Data

Dec. 26, 2006 (KR) ..... 10-2006-0133435

(51) Int. Cl.

| | |
|---|---|
| ***A47B 96/04*** | (2006.01) |
| ***A47B 88/00*** | (2006.01) |
| ***A47B 95/00*** | (2006.01) |
| ***A47B 9/00*** | (2006.01) |
| ***A47F 5/08*** | (2006.01) |
| ***A47G 29/02*** | (2006.01) |
| ***E04G 3/20*** | (2006.01) |
| ***E06B 7/28*** | (2006.01) |

(52) U.S. Cl. ..... 312/408; 211/153; 248/241; 312/351; 108/108

(58) Field of Classification Search ..... 312/408, 312/351; 108/106–110, 147.11, 147.17, 108/136; 248/235, 240, 241, 242, 250; 211/153, 211/187, 90.02
See application file for complete search history.

(56) References Cited

U.S. PATENT DOCUMENTS

| | | | | | |
|---|---|---|---|---|---|
| 2,838,357 | A | * | 6/1958 | Miller | 312/306 |
| 3,054,511 | A | * | 9/1962 | Erismann | 211/208 |
| 3,096,885 | A | * | 7/1963 | Peters | 248/240 |
| 3,885,846 | A | * | 5/1975 | Chuang et al. | 312/306 |
| 3,982,801 | A | * | 9/1976 | Heidorn et al. | 312/306 |
| 4,210,314 | A | * | 7/1980 | Carroll et al. | 254/8 B |
| 5,199,778 | A | * | 4/1993 | Aoki et al. | 312/408 |
| 5,913,584 | A | * | 6/1999 | Swindell et al. | 312/408 |
| 6,065,821 | A | * | 5/2000 | Anderson et al. | 312/408 |
| 6,364,136 | B1 | * | 4/2002 | Weshler et al. | 211/90.02 |
| 6,962,116 | B2 | | 11/2005 | Bienick et al. | |

FOREIGN PATENT DOCUMENTS

| | | | |
|---|---|---|---|
| DE | 102009000851 | A1 * | 8/2010 |
| FR | 1312569 | * | 11/1961 |
| JP | 03181774 | A * | 8/1991 |
| KR | 10-1999-0017805 | A | 3/1999 |
| KR | 10-1999-0034052 | A | 5/1999 |
| KR | 10-2004-0070000 | A | 8/2004 |

* cited by examiner

*Primary Examiner* — Janet M Wilkens
*Assistant Examiner* — Andrew Roersma
(74) *Attorney, Agent, or Firm* — Birch, Stewart, Kolasch & Birch, LLP

(57) ABSTRACT

A refrigerator is provided. The refrigerator includes a shelf member provided in the refrigerator; a position setting member positioning the shelf member at the set height; a guide member maintaining the connection state of the shelf member and the position setting member; and a rise induction mechanism allowing the shelf member to be raised by stages as connected with the position setting member.

23 Claims, 6 Drawing Sheets

REFRIGERATOR WITH RISE INDUCTION MEMBER

TECHNICAL FIELD

The present invention relates to a refrigerator.

BACKGROUND ART

In general, a refrigerator is a home appliance to maintain foods to be fresh for a long time as storing them under a low temperature.

More particularly, a refrigerator is provided with a cold room storing foods such as vegetables under the fresh state as maintaining the cold room within one to four degrees Centigrade and a freezing room storing foods such as meats and fishes under the frozen state as maintaining the freezing room to −18 degrees Centigrade.

Further, there are some types of refrigerators in accordance with methods such as a type that the freezing room is positioned above the cold room, a type that the freezing room is positioned under the cold room, and a type that the freezing room and the cold room are positioned next to each other.

Furthermore, refrigerators may be divided into a double-door type refrigerator that doors are installed at each of the left and right sides of a refrigerator and a single-door type refrigerator that each door is installed at the upper part and the lower part of the refrigerator.

On one hand, a refrigerator is maintained under the cooling state or frozen state through the method that refrigerant and the air in the refrigerator are heat exchanged as the refrigerant forms the refrigeration cycle.

Further, a refrigerator is provided with shelves on which foods are laid arranged in the cooling room and the freezing room up and downwardly or provided with a container arranged as capable of sliding to contain foods.

On the other hand, various sizes of foods or containers are contained in the cooling room or in the freezing room. For example, hexahedral or rounded shapes of vessels or containers, or long bottles are contained in the cooling room or in the freezing room. Here, containers that the up-and-down length is ling are not sometimes easy to be contained in the refrigerator because of the narrow intervals between the shelves.

DISCLOSURE OF INVENTION

Technical Problem

However, the structure of the related refrigerators has some disadvantages that users have difficulty in storing bottles in the cooling room, because it is not easy to control the high and low of the shelves.

A guide member that is protruded at the side of the inside of the refrigerator with a predetermined interval is provided in the structure of the related refrigerator to control the height of the shelves, and the structure that the shelves are separated and inserted into the refrigerator as sliding along the guide members at the proper places is being proposed.

However, a lot of foods or containers are usually put on the corresponding shelves that the height has to be controlled in case of these kinds of shelf structures.

In order to control the height of the shelves in this situation, users have to move the shelves to the place where they want as pulling the shelves toward them with a force capable of bearing the load of the objects on the shelves.

Therefore, it is hard for women or olds and feeble people to control the height of the shelves, and sometimes foods or containers on the shelves fall down and are broken when users separate the shelves.

The present invention is proposed to overcome the above-mentioned disadvantages, and an object of the present invention is to provide a refrigerator that the height of the shelves provided in the cooling room and the freezing room is controlled easily.

Particularly, another object of the present invention is to provide a shelf rise-and-fall equipment of a refrigerator that the height of shelves are controlled without any difficulties at the state that the shelves are not separated from the cooling room or from the freezing room.

Further, another object of the present invention is to provide a shelf rise-and-fall equipment of a refrigerator allowing the external appearance of the shelf members to be sleek and clean as the structure of the shelf rise-and-fall equipment is not shown to outside as the shelf rise-and-fall equipment is formed a part of the shelf members.

Furthermore, another object of the present invention is to provide a structure of the shelf rise-and-fall equipment of a refrigerator allowing the inside of the refrigerator to be used widely in accordance with the occasion demands as arranging the shelf assembly equipped with a shelf rise-and-fall equipment as capable of separated.

Technical Solution

A refrigerator according to the present invention to achieve the above-mentioned objects comprises a shelf member provided therein; a position setting member positioning the shelf member at a set height; a guide member maintaining the connection state of the shelf member and the position setting member; and a rise induction means allowing the shelf member to be raised by stages as connected with the position setting member.

A refrigerator according to another aspect of the present invention comprises a shelf member; a position setting member setting the height of the shelf member; an elevating member raising and falling the shelf member by discontinuously contacting to the position setting member; and a track provided to an inner wall of the refrigerator, and positioning the position setting member at a predetermined height.

A refrigerator according to further another aspect of the present invention comprises A refrigerator comprising: a shelf member provided in the cooling room or in the freezing room; an elevating member provided at a side surface of the shelf member and including a lever to raise the shelf member; and a position setting member setting the height of the shelf member as connected with the elevating member, wherein the lever forms a part of the shelf member.

A refrigerator according to further another aspect of the present invention comprises a shelf member on which foods are laid; an elevating member equipped with a rise lever to control the height of the shelf member; and a position setting member leading the shelf member to be stopped at a set height as an end of the rise member is fixed thereto, wherein the shelf member is raised by stages through the up and down movement of the rise lever.

A refrigerator according to further another aspect of the present invention comprises a shelf member provided therein; a position setting member positioning the shelf member at a set height; a guide member leading the connection of the shelf member and the position setting member to be maintained; a rise induction means inducing the shelf member to be raised as connected with the position setting member; and a fall induction means releasing the coupling of the rise induction means and the position setting member, and inducing the shelf member to be fallen by its load.

A refrigerator according to further another aspect of the present invention comprises a shelf member provided therein; a fastening member provided at least on a side of the shelf member; a track provided on the inner wall and catching the fastening member; and a sliding member leading the shelf member to be raised stably.

Advantageous Effects

The refrigerator according to the present invention to achieve the above-mentioned objects has an advantageous effect in that the height of the shelves provided in the cooling room or in the freezing room is easily controlled.

Particularly, the refrigerator according to the present invention to achieve the above-mentioned objects has an advantageous effect in that the height of the shelf is controlled without difficulties at the state that it is not separated from the cooling room or from the freezing room. Accordingly, it is prevented that foods fall down or containers fall down and are broken when users separate the shelf to control the height of the shelf.

Further, it is effective that external appearance of the shelf member becomes sleek and clean, as the structure of the rise-and-fall equipment is not shown to outside as the shelf rise-and-fall equipment forms a part of the shelf member.

Further, it is effective that the inside of the refrigerator may be used widely according to the occasion demands as arranging the shelf assembly provided with a rise-and-fall equipment as separating from the refrigerator.

Furthermore, it I effective that the time taken for controlling height is reduced as the shelf is positioned clearly at the desirable place as rise is processed by stages and the fall is processed continually.

MODE FOR THE INVENTION

Reference will now be made in detail as for the preferred embodiment of the present invention with accompanying drawings. However, the idea of the present invention is not limited to the presented preferred embodiments, and other preferred embodiments included in the idea of other related invention or of the present invention may be suggested easily as added with new elements, changed and deleted.

Figure 1:
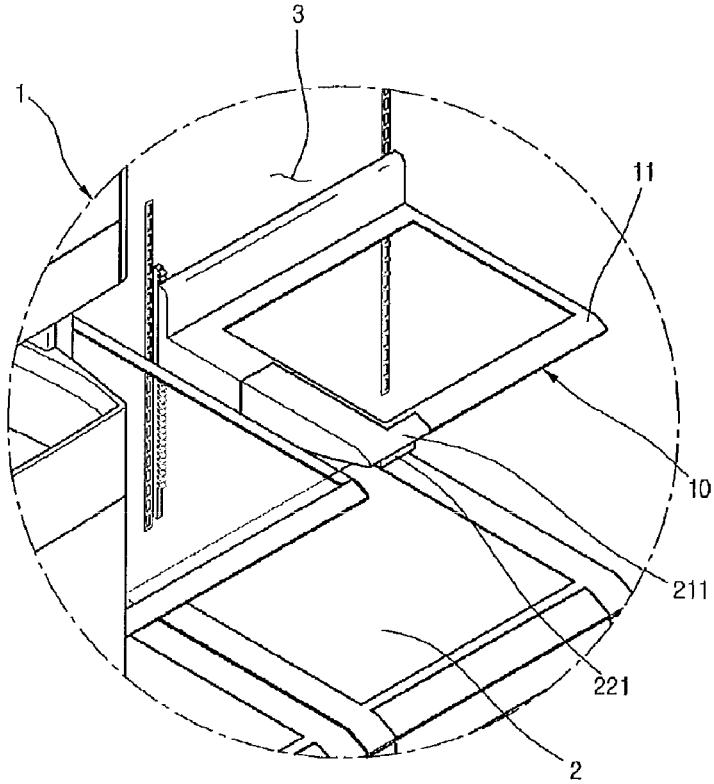
FIG. 1 is an inner perspective view of a refrigerator provided with a shelf assembly according to an idea of the present invention that the height may be controlled.
Figure 2:
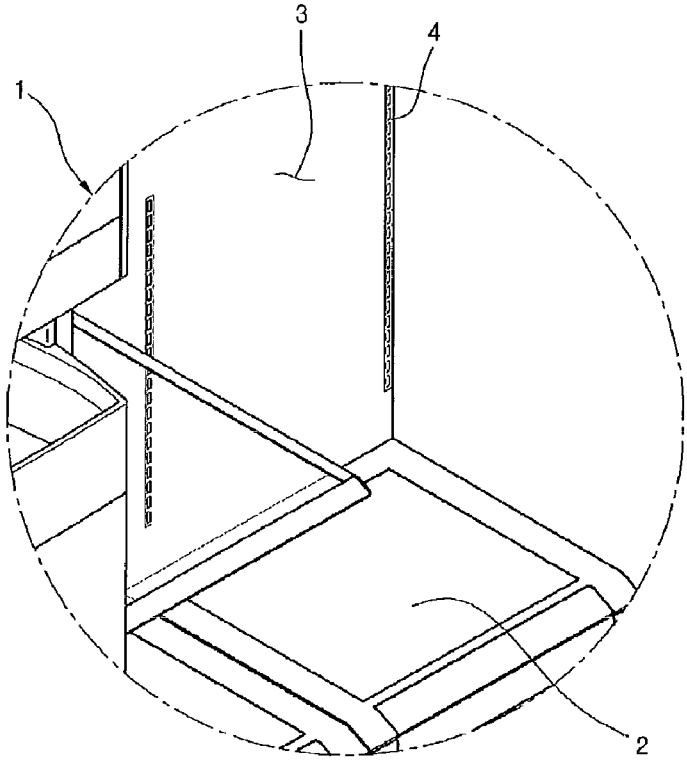
FIG. 2 is an inner perspective view of a refrigerator at the state that a shelf assembly is separated.

FIG. 1 is an inner perspective view of a refrigerator provided with a shelf assembly according to an idea of the present invention that the height may be controlled, and FIG. 2 is an inner perspective view of a refrigerator at the state that a shelf assembly is separated.

Referring to FIGS. 1 and 2, the shelf assembly 10 according to the present invention that the height may be controlled is provided in the cooling room 3 or freezing room (not shown) of a refrigerator 1, and is coupled with the rear wall as capable of separated. A storing box 2 in which foods may be contained with the shelf assembly 10 may be provided in the cooling room 3 or in the freezing room.

Reference will now be made in detail as for a preferred embodiment that the height of the shelf assembly 10 is controlled as installed in the cooling room 3.

Particularly, a track 4 which the shelf assembly 10 is attached to and separated from is provided on the rear surface in the cooling room 3. Here, the track 4 is formed as two of them are formed as having a predetermined interval between them to support the ends of the both sides of the shelf assembly 10.

More particularly, a plurality of holes is provided up and down with predetermined intervals at the track 4, and a fastening member (to be illustrated on the following) inserted in the hole is formed at the end of the rear side of the shelf assembly 10. Therefore, it is effective that the shelf assembly 10 may be coupled with the track 4 as capable of attached and separated, and the installation height may be selected with freedom when the shelf assembly 10 is installed.

On the other hand, the shelf assembly 10 comprises a setting plate 11 on which foods are laid, a shelf member composed of a frame 12—refer to FIG. 3—forming the circumference of the setting plate 11, and a re-and-fall member-will be described on the following—provided with a rise lever 211 and a fall lever 221 to control the height of the shelf member. The description as for the composition of the elevating member and the method for controlling the height of the shelf member will be made in detail on the following with accompanying drawings.

Figure 3:
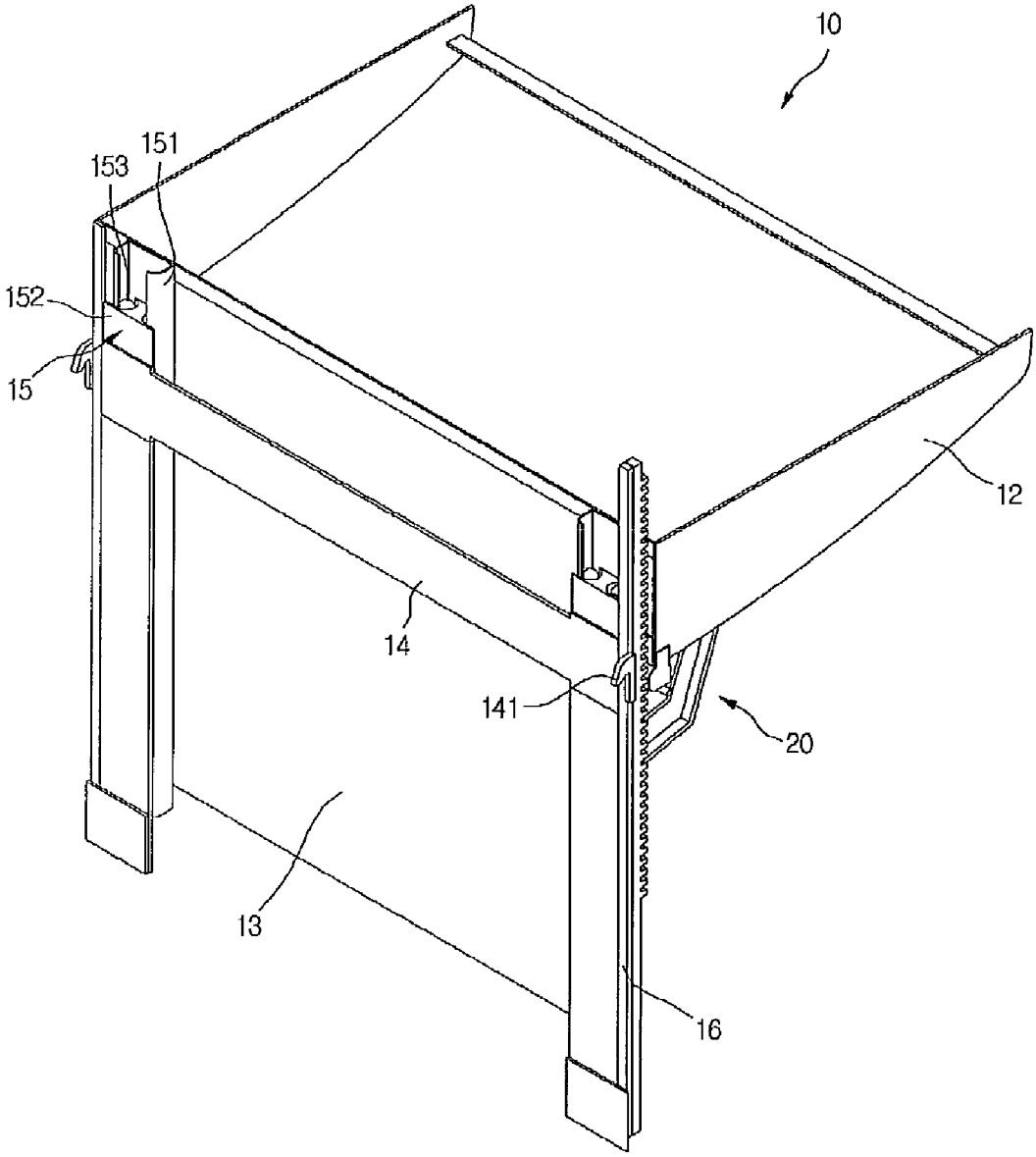
FIGS. 3 and 4 are perspective views illustrating the compositions of a shelf assembly according to the idea of the present invention that the height may be controlled.
Figure 4:
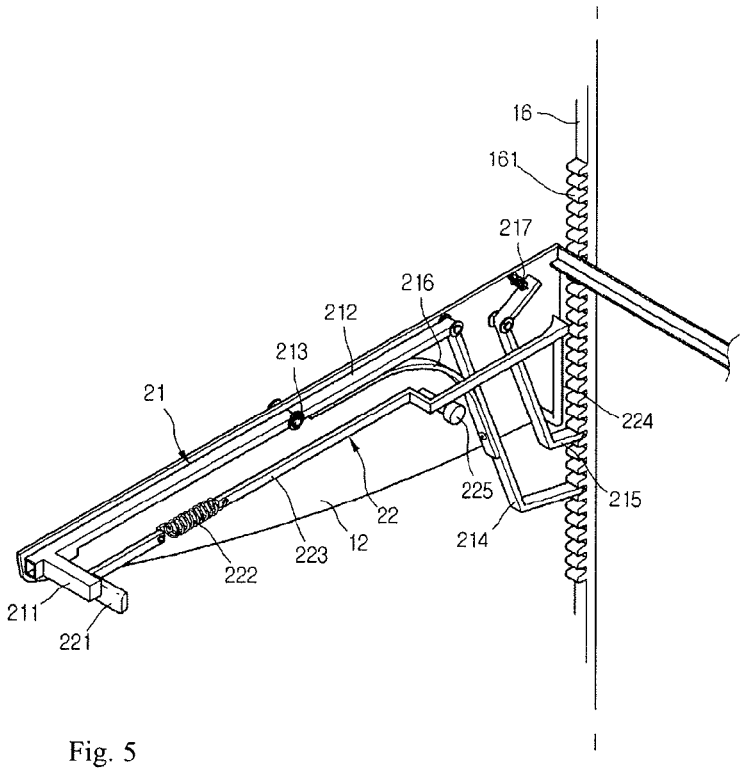

FIGS. 3 and 4 are perspective views illustrating the compositions of a shelf assembly according to the idea of the present invention that the height may be controlled.

Referring to FIGS. 3 and 4, the shelf assembly according to the present invention comprises a shelf member, an elevating member 20 to control the height of the shelf member, a back plate 13 supporting the shelf member and the elevating member 20, a guide member 15 allowing the shelf member to be moved up and down stably as provided at the rear surface of the back plate 13, a position setting member 16 allowing the shelf member to be positioned at the set height as provided at an edge of the back plate 13, and a coupling bar 14 connected with the guide member 15 and the position setting member 16 at the same time and having a fastening end 141 at both of the ends.

Particularly, the fastening end 141 supports the shelf assembly 10 as inserted into the hole formed at the track 4, and prevents the shelf member to be inclined forwardly by the load of foods.

More particularly, the shelf member includes a setting plate 11 and a frame 12 as described above. Here, a plurality of fastening protrusions 161 is protruded with fixed intervals at the front surface of the position setting member 16. The fastening protrusion 161 allowing the shelf member to be fall by its load as letting an end of the elevating member 20 is supported as hooked. Here, the means catching the end of the elevating member 20 may be a protrusion such as the fastening protrusion 161 or may be a groove or a hole of predetermined size. That is, it is possible that all structure that an end of the elevating member 20 is supported as hooked may be suggested.

Further, the guide member 15 is provided at both sides of the back plate 13, and is composed of a driving guide 151, a driven guide 152, and a bearing 153 inserted into a lateral surface of the driving guide 151 and the driven guide 152.

More particularly, the driving guide 151 is formed with the frame 12 of the shelf member and the back plate 13 in a single structure, and the driven guide 152 is fixed at the coupling bar 14. Therefore, the driven guide 152 and the position setting member 16 form a single structure by the coupling bar 14. The driven guide 152 and the position setting member 16 are fixed on the surface in the refrigerator as the fastening protrusion 141 is fixed at the track 4.

Further, at the rising process of the shelf member, the driving guide 151 moves down and up along the driven guide 152 by the rotation of the bearing 153. Further, the shelf member and the back plate 13 rise or fall in a single structure with the rise and fall of the driving guide 151.

The elevating member 20 is coupled with a side surface of the shelf member that is the frame 12.

Particularly, the elevating member 20 includes a rise induction means 21 inducing the rise of the shelf member and a fall induction means 22 inducing the fall of the shelf member.

More particularly, the rise-and-fall induction means 21 includes a rise lever 211 that users can grab and control it up and down, a rise induction bar 212 extended from the rise lever 211 horizontally, a push leg 214 connected to the end of the rise induction bar 212 as widen for a predetermined angle, a pressurizing member 216 that the both ends are connected to each of the rise induction bar 212 and the push leg 214, and a stopping leg 215 that an end of it is connected to the inside surface of the frame 12 and the other end of it is caught at the position setting member 16 as bent for a predetermined angle.

On the other hand, a part of the rise induction bar 212 is coupled with the frame 12 by the rotating shaft 213. Further, an end of the push leg 214 is caught at the position setting member 16 as bent for a predetermined angle.

Further, the end of the push leg 214 may be linked with the rise induction bar 212 or may be connected with the rise induction bar 212 indirectly by the compressing member 216. The compressing member 216 compresses the push leg 214 toward the position setting member 16 all the time as it is provided in a form of leaf spring having a predetermined elasticity. That is, the push leg 214 prevents the shelf member to fall by itself with its load as compressed at the position setting member 16.

Further, the stopping leg 215 rises and falls with the frame 12 as connected with the frame 12 as separate from the rise induction bar 212.

An end of the stopping leg 215 is coupled with the frame as capable of rotating, and the end connected with the frame 12 is connected to a spring 21 having a predetermined elasticity. It is proper for the spring 21 to be a compressing spring.

That is, the other end of the stopping leg 215 is separated from the position setting member 16 as the spring 217 is tensed when the shelf member is risen or fallen, and the other end of the stopping leg 215 is strongly stock to the position setting member 16 as the spring 217 is contracted back at the state that the shelf member is fixed.

Further, the rise lever 211 is not shown to outside clearly as it is formed as a part of the shelf member, and accordingly, the area that can be used becomes wider.

That is, the disadvantage is overcome that the area of the shelf member becomes small by the bulk of the rise lever 211 as forming the rise lever 211 to be on the same lever with the shelf member that is the setting plate 11 when the rise lever 21 is not driven. It is possible that a stopper (not shown) to be protruded from the frame 12 to prevent the rise lever 211 to fall from the plane state. That is, it is prevented for the rise lever 211 to fall from the plane state as setting the rise lever on the stopper protruded from the frame 12. Accordingly, it is prevented for the rise lever 211 to be driven downwardly by the load of the food on the shelf member.

The fall induction means 22 includes a fall lever that a user can grab and pull, a fall induction bar 223 extended from the fall lever 221 horizontally, a release unit 224 extended and bent downwardly from an end of the fall induction bar 223, and a spring 222 connecting the fall lever 221 and the fall induction bar 223.

Particularly, the fall induction bar 223 retreats back after advancing by the spring 222 when a user pulls the lever and releases it. The stopping leg 215 and the push leg 214 break away from the position setting member 16 as the release unit 224 advances with the advance of the fall induction bar 223. Here, the shape of the release unit 224 is not limited to the shape provided in the preferred embodiment, and any structure that allows the push leg 214 and the stopping leg 215 to be broken away from the position setting member 16 optionally.

Further, the horizontal movement of the fall induction bar 223 is secured by the supporting bar 225 protruded from the frame 12.

To rise the shelf member with the above-mentioned structure, it is required for the shelf member to be risen by stages with the continuous movement that the rise lever 211 is risen and released. To fall the shelf member, the push leg 214 and the stopping leg 215 have be separated from the position setting member 16 as the fall lever 221 is pulled. Then, the shelf member quickly falls while the lever is pulled and released.

Here, to prevent the rapid fall of the shelf member, it is possible that a damping member 15 is provided at aside of the shelf assembly 20.

As an available preferred embodiment, it is possible that a damping member using elasticity or an oil pressure to be attached in the guide member 15 or at a side surface of the driving guide 151. That is, it is possible that a resisting power is not generated when the shelf member rises but a resisting power corresponding to the kinetic energy generated when the shelf member falls.

As an available damping means, it is possible to install as the length of a spring becomes shortened when shelf member rises as using a compressing spring and the spring is tensed when the shelf member falls. Then, the shelf member falls slowly by the compressive dynamic stability affected to the spring while the shelf member falls down.

In case that the compressing damper structure is applied, the rapid fall of the shelf member is prevented as the volume of the inside of the cylinder is increased wile the shelf member rises, and as a resisting force is generated as the inside of the cylinder is compressed while the shelf member falls down.

In this preferred embodiment, the detailed structure and the installation position of the structure of the damping member will not be described through accompanying drawing as they are things easily installed at the level of the present manufacturer. Merely, the idea that a damping member is applied to prevent the rapid fall of the shelf member is included in the idea of the present invention.

Reference will now be made in detail as for the rising and falling processes of the shelf assembly according to the present invention with reference to the accompanying drawings.

Figure 5:
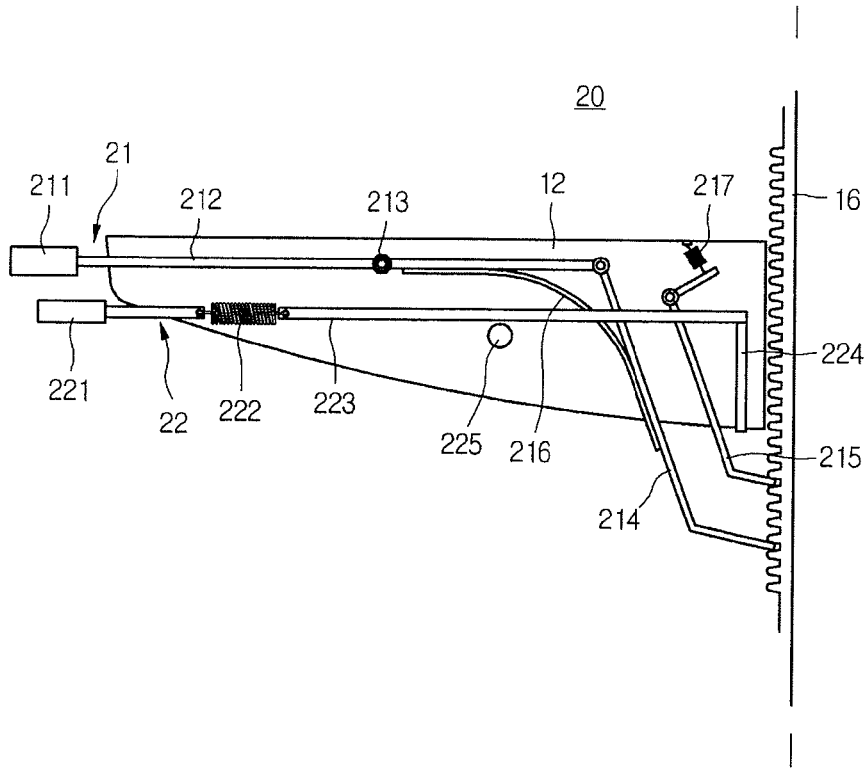
FIG. 5 is a schematic diagram briefly illustrating the state that a shelf assembly according to the present invention is fixed.

FIG. 5 is a schematic diagram briefly illustrating the state that a shelf assembly according to the present invention is fixed.

Referring to FIG. 5, the rise induction means 21 is supported as suspended on the position setting member 16 when the shelf member according to the present invention is fixed at a specific place, and the fall induction means 22 is maintained under the state that the effort is not passed to the rise induction means 21. Here, the effort is a force releasing the push leg 214 and the stopping leg 215 from the position setting member 16.

That is, the bent end of the push leg 214 of the rise induction means 21 and the bent end of the stopping leg 215 are maintained to be fixed as suspended on the fastening means formed on the front surface of the position setting member 16, further, the release unit 225 of the fall induction means 21 is positioned at a place adjacent to the push leg 214 and the stopping leg 215.

The rise induction means 21 is fixed at the frame 12 by the rotating shaft 213. The fall induction means 21 rises and falls with the frame as supported by the supporting bar 225 protruded from the frame 12.

Figure 6:
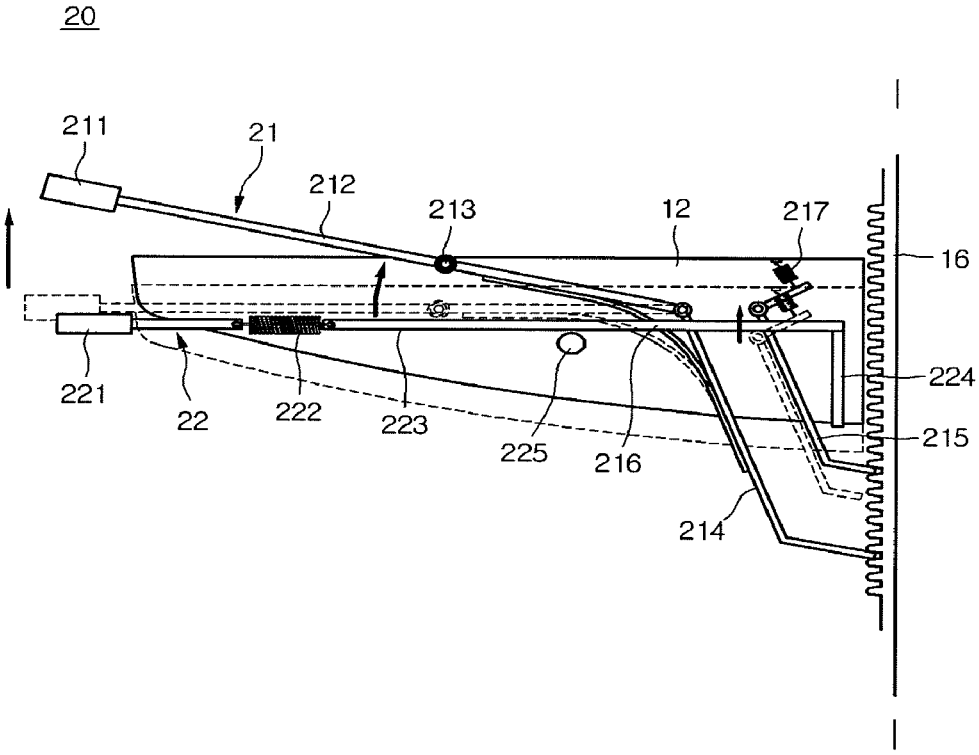
FIG. 6 is a driving state diagram illustrating the process that the shelf member is being raised through the elevating member according to the idea of the present invention.
Figure 7:
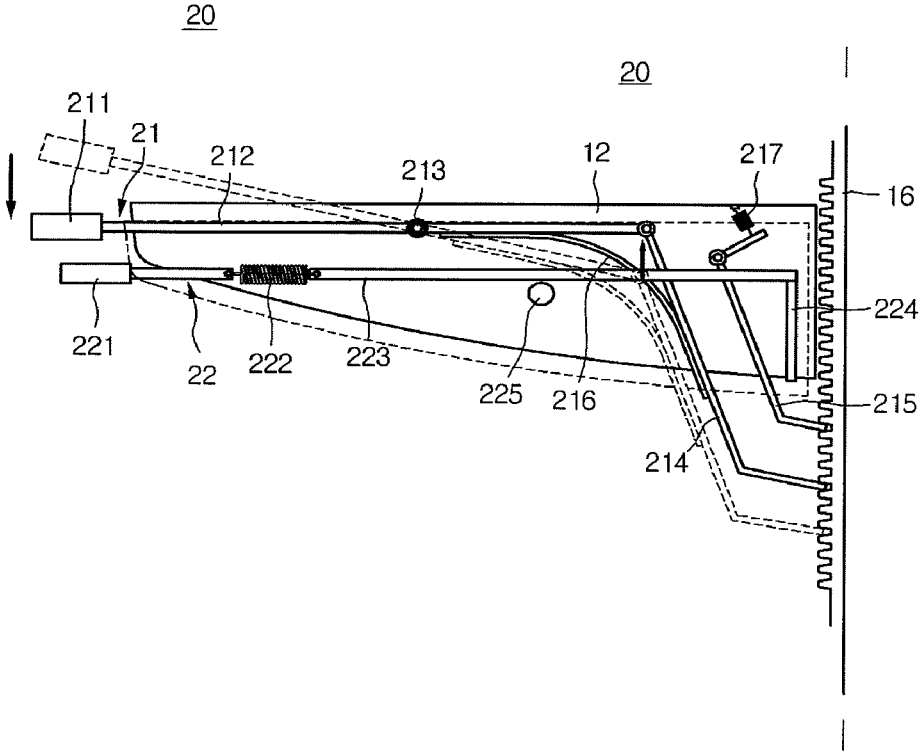
FIG. 7 is a driving state diagram illustrating the process that the shelf member according to the idea of the present invention is maintained as raised to a predetermined height.

FIG. 6 is a driving state diagram illustrating the process that the shelf member is being raised through the elevating member according to the idea of the present invention, and FIG. 7 is a driving state diagram illustrating the process that the shelf member according to the idea of the present invention is maintained as raised to a predetermined height.

The processes in FIGS. 6 and 7 are processed continually in order to raise the shelf member according to the present invention, then, the shelf member is raised to the established height.

Referring to FIG. 6, to raise the shelf member, a user grabs the rise lever 211 and put it up. Then, the frame 12 is raised with the rise induction bar 212. That is, the shelf member is also raised as with the rise of the rise induction bar 212 by the rotating shaft 213.

Further, the angle formed by the rise induction bar 212 and the push leg 214 becomes widen while the rising process. Here, the end of the push leg 214 is maintained to be close to the position setting member 16 by the elasticity of the compressing member 216 when the rise induction bar 212 is raised.

Here, the stopping leg 215 connected to the frame 12 is also raised with the frame 12. Particularly, the end of the stopping leg 215 is separated from the position setting member 16 as the spring 217 is tensed at the process that the stopping leg 215 is raised. The stopping leg 215 is closed back to the position setting member 16 by the dynamic stability of the spring 217 at the state that the stopping leg 215 is raised to a predetermined height. That is, the end of the stopping leg 215 is closed to the position setting member 16 at the place higher than the former place. Then, the shelf member becomes stopped at the state raised to a predetermined height.

Referring to FIG. 7, the process that the rise lever 211 falls down to the origin position at the state that the stopping leg 215 is raised and fixed on the position setting member 16.

Particularly, when the raised rise lever 211 is released, the rise induction bar 212 rotates with the rotating shaft 213 as a starting point. Therefore, the connection point of the end of the rise induction bar 212 and the push leg 214 are raised as illustrated.

More particularly, when the rise lever 211 is released, the end of the push leg 214 is raised as swell as separated from the position setting member 16 as the compressing member 216 is pursed in the direction that the curvature becomes smaller. In this process, the stopping leg 215 is maintained to be close to the position setting member 16. When the rise induction bar 212 becomes horizontal, the end of the push leg 214 is closed back to the position setting member 16 by the dynamic stability of the compressing member 216.

As the above-mentioned movement is processed once, the shelf member is raised once. As this process is processed continually, the shelf member is raised by stages.

Further, the raised height of the shelf member for one time is decided in accordance with the raised height of the rise lever 211. That is, as the height of the rise lever 211 becomes higher, the raised height of the shelf member for one time becomes bigger, and as the rise lever 211 is raised a little bit, the raised height of the shelf member for one time becomes smaller.

Figure 8:
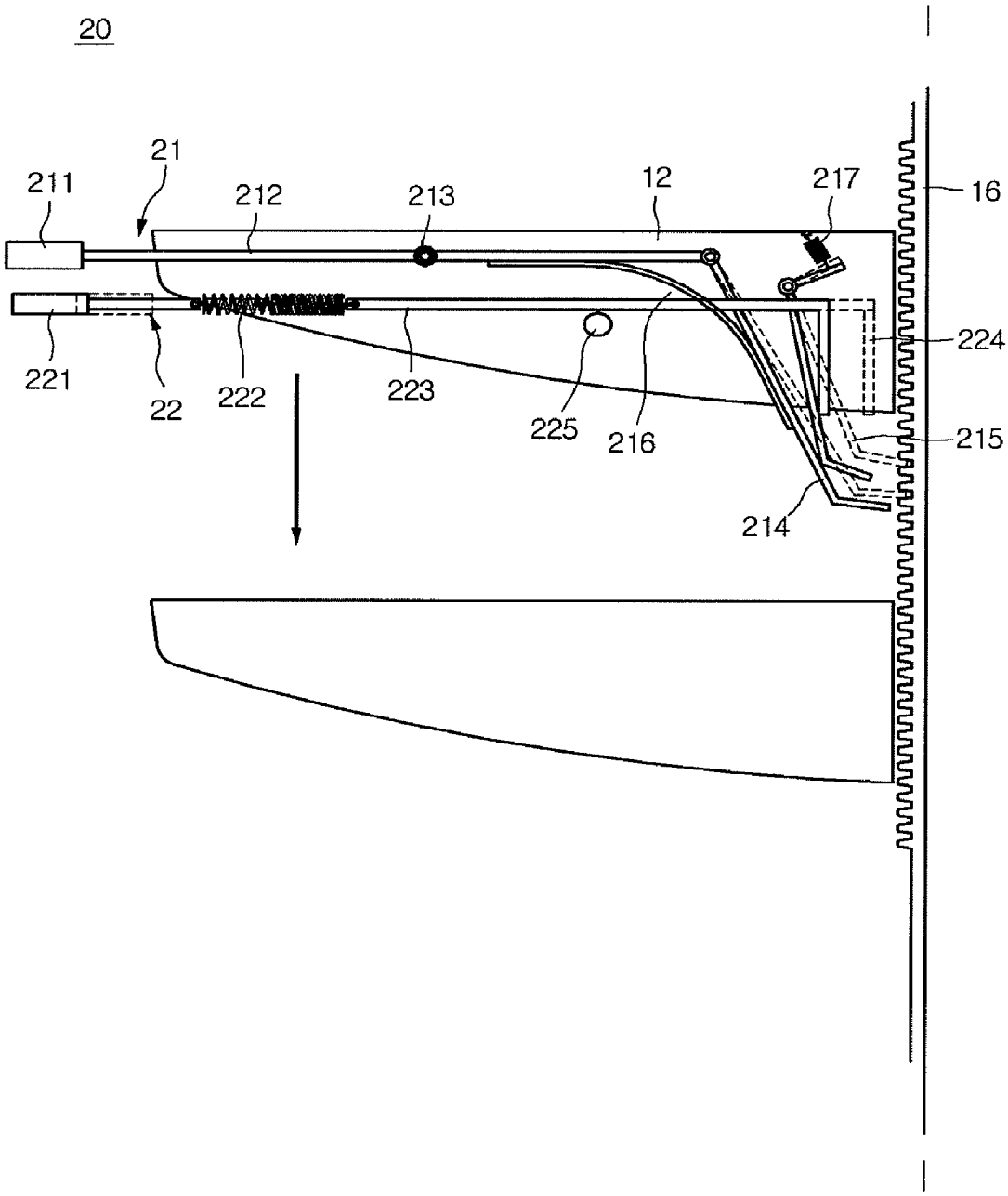
FIG. 8 is a driving state diagram illustrating the process that the shelf member according to the idea of the present invention falls down.

FIG. 8 is a driving state diagram illustrating the process that the shelf member according to the idea of the present invention falls down.

Referring to FIG. 8, a user pulls the fall lever 221 forwardly at the state of FIG. 5. Here, the spring 222 is tensed and the fall induction bar 223 is drawn out. Further, the release unit 225 connected to an end of the fall induction bar 223 is also drawn out.

Particularly, the release unit 225 pushes the stopping leg 215 and the push leg 214 forwardly as it is drawn out. Then, the ends of the stopping leg 215 and the push leg 214 are separated from the position setting member 16.

More particularly, the end of the stopping leg 215 moves forwardly by the operation of the release unit 225 as rotating. Further, the stopping leg 215 that is rotating leads the separation of the push leg 214 from the position setting member 16 as pushing the push leg 214. The shelf member falls under down at the sate that the ends of the stopping leg 215 and the push leg 214 are separated from the position setting member.

On the other hand, when a user release the fall lever 221, the fall induction bar 223 retreats as the fall lever 221 is pushed by the dynamic stability of the spring 222. Further, the release unit 225 retreats with the retreat of the fall induction bar 223. Further, the release unit 225 is separated from the stopping leg 215 and the push leg 214.

Accordingly, the lower end of the stopping leg 215 is closed to the position setting member 16 by the dynamic stability of the spring 217 connected to the upper end of the stopping leg 215. At the same time, the fall of the shelf member stops.

Further, when the shelf member falls, it is prevented through the damping member that the shelf member bumps against the bottom in the refrigerator as it falls rapidly.

Figure 9:
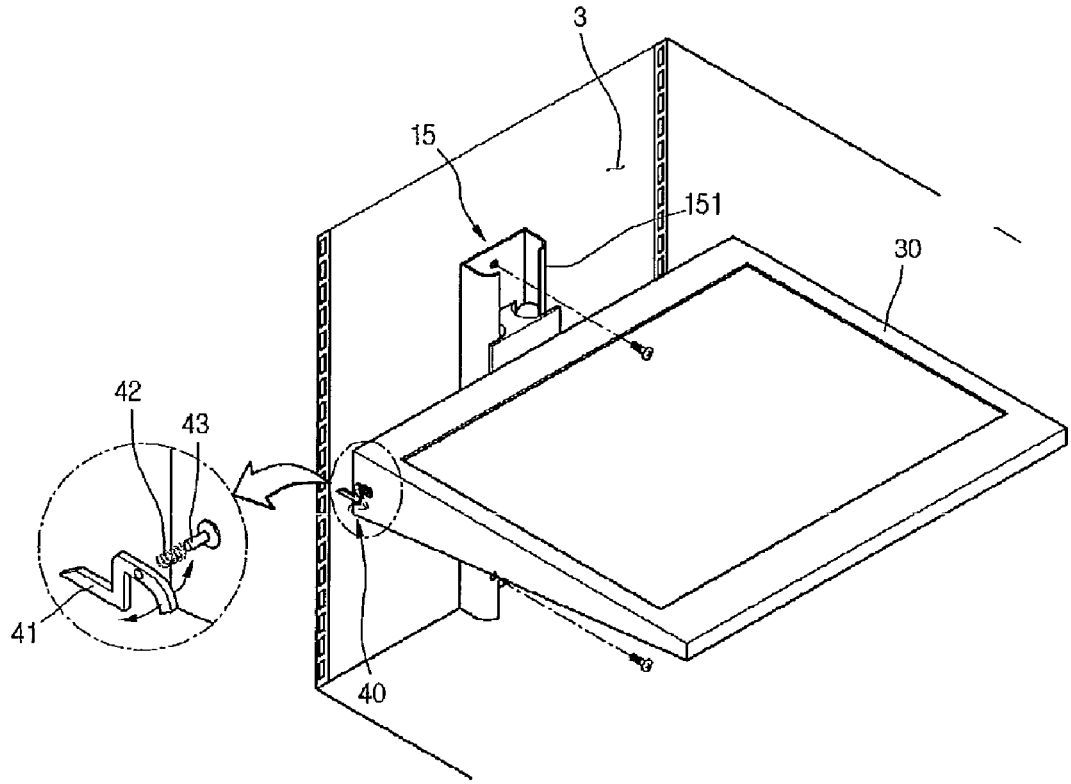
FIG. 9 is a disassembled perspective view illustrating another preferred embodiment of a shelf assembly according to the idea of the present invention.
Figure 10:
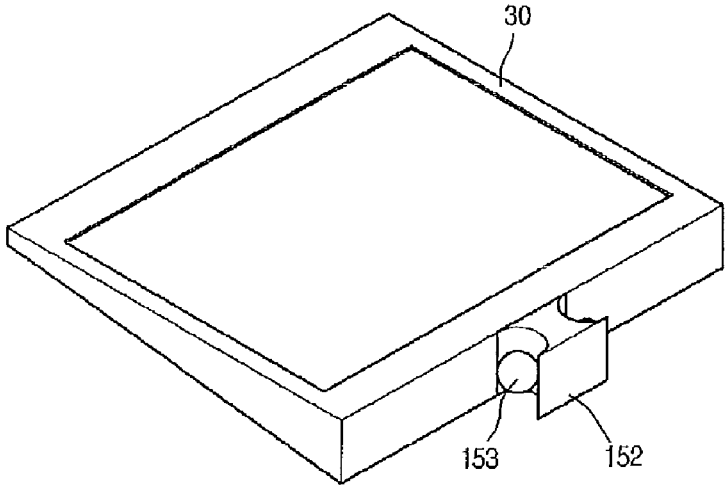
FIG. 10 is a rear perspective view of a shelf member according to another preferred embodiment of the present invention.

FIG. 9 is a disassembled perspective view illustrating another preferred embodiment of a shelf assembly according to the idea of the present invention, and FIG. 10 is a rear perspective view of a shelf member according to another preferred embodiment of the present invention.

Referring to FIGS. 9 and 10, the present preferred embodiment provides a structure that a user raises and takes down the shelf member as holding a fastening means provided at a side of the shelf member.

Particularly, a fastening means 40 coupled as capable of rotating is provided at the both sides of the shelf member 30, and a track 4 in which the fastening means 40 is inserted is attached up and downwardly on the surface in the refrigerator.

Further, a guide member 15 raising and falling the shelf member 30 at the coupled state is provided on the inner surface of the refrigerator, and the composition of the guide member 15 is the same to the above-mentioned guide member 15. Merely, the length of the driven guide 152 coupled with the rear of the shelf member 30 is provided as proper to the thickness of the shelf member 30, and there is a little bit of difference on movements of the driven guide 152 in the up and down direction in the refrigerator. However, the coupling place of the driving guide 151 and the driven guide 152 is changeable, and other guide members of other structure processing the same function are applicable.

On the other hand, the fastening means comprises a latch 41 which users rotate it as holding it with hands, a shaft 43 protruded at a side surface of the shelf member 30 for the latch 41 to be fitted, a spring 42 fitted at the shaft and that the elasticity is generated by the rotation of the latch.

Particularly, when a user holds the latch 41 and rotates it upwardly, the latch 41 is separated from the track 41 and the elastic dynamic stability is accumulated on the spring 42. Further, when a user releases the latch 41 at the state that the shelf member 30 is raised or fallen to a specific position, the latch 41 is rotated backwardly by the dynamic stability of the spring 42. Further, the end of the latch 41 is fitted into the track 4.

Further, the inclination of the shelf member 30 due to load is prevented by the guide member 15. That is, the load of the shelf member 30 is supported through the guide member 15. Further, the shelf member 30 rises smoothly by the guide member 15.

According to the above-mentioned structure, it is prevented that foods, other containers and etc on the shelf member 30 falls down to the floor as it is possible for the shelf member 30 to be raised and fallen at the state not separated from the inner surface of the refrigerator.

INDUSTRIAL APPLICABILITY

According to the provided rise-and-fall structure of a shelf, it is possible that industrial applicability becomes higher as the customer satisfaction becomes higher as the use of the space of the cooling room or freezing room becomes higher as the height of the shelf is easily controlled in accordance with the sizes of the containers stored in the refrigerator.

The invention claimed is:

1. A refrigerator comprising:

a shelf member provided therein;

a position setting member positioning the shelf member at a set height;

a guide member maintaining a connection state of the shelf member and the position setting member;

a rise induction member allowing the shelf member to be raised by stages as connected with the position setting member, the rise induction member comprising:

a rise lever that is graspable by a user's hands;

a rise induction bar rotatably coupled to a point of the shelf member;

a push leg of which one end is suspended on the position setting member and another end is connected to the rise induction bar directly or indirectly; and a stopping leg maintaining the shelf member as raised;

a compressing member having one end connected to the rise induction bar and and having the other end connected to one end of the push leg and that compresses another end of the push leg to be contacted with the position setting member; and an elastic member compressing the stopping leg to be contacted with the position setting member.

2. The refrigerator according to claim 1, wherein the rise lever is configured to be part of the shelf member.

3. The refrigerator according to claim 1, wherein the guide member comprises a driving guide connected to the shelf member and a driven guide coupled with the driving guide as capable of sliding, and the driven guide and the position setting member are integrally fixed in the refrigerator in a single structure.

4. The refrigerator according to claim 1, wherein the shelf member is detachably connected to an inner wall of the refrigerator.

5. The refrigerator according to claim 1, further comprising a track provided to an inner wall of the refrigerator, and positioning the position setting member at a predetermined height.

6. The refrigerator according to claim 5, further comprising a coupling member on which the guide member and the position setting member are fixed and coupled to the track.

7. The refrigerator according to claim 6, wherein the coupling member includes a fastening end protruded at the position setting member, and the track includes a fastening end receiver in which the fastening end is fitted at a predetermined height.

8. The refrigerator according to claim 7, wherein the fastening end is configured to be separable from the fastening end receiver, and a position where the fastening end is coupled to the fastening end receiver is adjustable.

9. The refrigerator according to claim 1, further comprising a fall induction member inducing fall of the shelf member by pulling the fall induction member.

10. The refrigerator according to claim 9, wherein, when the fall induction member is pulled out, the stopping leg and the push leg are separated from the position setting member and the shelf member is placed in a falling state.

11. The refrigerator according to claim 9, wherein, when the fall induction member is pulled out, a connection with the rise induction member and the position setting member is released and fall of the shelf member continues until the fall induction member is pushed in.

12. The refrigerator according to claim 1, further comprising a damping member provided on a side of the guide member and preventing rapid fall of the shelf member.

13. The refrigerator according to claim 1, wherein the rise lever forms a part of the shelf member.

14. The refrigerator according to claim 13, wherein the rise lever forms a plane surface with the shelf member at a stopped state.

15. The refrigerator according to claim 13, wherein the shelf member is raised one time by a movement that the rise lever is raised and fallen.

16. The refrigerator according to claim 15, wherein a raised height of the shelf member at one time becomes higher, as an angle that the rise lever is raised becomes higher.

17. The refrigerator according to claim 1, wherein the compressing member is a leaf spring having a predetermined elasticity.

18. The refrigerator according to claim 1, wherein another end of the stopping leg is fixed to the position setting member after raised a predetermined height when the rise lever is raised, and another end of the push leg is fixed to the position setting member when the rise lever is released, whereby the shelf member is raised the predetermined height.

19. The refrigerator according to claim 1, wherein a predetermined part of the rise induction member is rotatably connected to the shelf member and a rotation angle drawn by the rise induction member and the shelf member is proportional to a raise height of the shelf member.

20. The refrigerator according to claim 1, wherein the shelf member is raised by stages through up and down movement of the rise lever.

21. The refrigerator according to claim 1, wherein the guide member comprises:

a driving guide coupled to a rear surface of the shelf member; and a driven guide connected to an inner wall of the refrigerator directly or indirectly, wherein the driving guide slides along the driven guide with the shelf member raised and fallen at a horizontal state.

22. The refrigerator according to claim 21, wherein the driven guide is indirectly connected to the inner wall of the refrigerator by a fastening end of which position at the inner wall of the refrigerator is controllable.

23. The refrigerator according to claim 21, wherein the position setting member is fixed to the inner wall of the refrigerator together with the driven guide.

* * * * *